United States Patent [19]

Fink

[11] 4,397,267

[45] Aug. 9, 1983

[54] TECHNIQUE AND APPARATUS FOR SOLIDS CIRCULATION CONTROL IN THE SOLIDS CIRCULATING BOILER

[75] Inventor: Carl E. Fink, McMurray, Pa.

[73] Assignee: Conoco Inc., Stamford, Conn.

[21] Appl. No.: 289,542

[22] Filed: Aug. 3, 1981

[51] Int. Cl.[3] ..... F22B 1/02

[52] U.S. Cl. ..... 122/4 D; 110/245; 165/104.16; 431/7; 431/170

[58] Field of Search ..... 122/4 D; 110/245; 431/7, 170; 165/104.16

[56] References Cited

U.S. PATENT DOCUMENTS

| | | | |
|---|---|---|---|
| 3,921,590 | 11/1975 | Mitchell et al. | 122/4 D |
| 4,240,377 | 12/1980 | Johnson | 122/4 |
| 4,335,683 | 6/1982 | Criswell et al. | 122/4 D |

OTHER PUBLICATIONS

Foxboro Company, Book No. 1528, d/p Cell Transmitter, Sep. 1955, p. 1.

Foxboro Company, Book No. 1755, Consotrol Recorder Models 53, 54 with Set Point Transmitter, Apr. 1963, p. 1.

Fink, Carl E. and Vardaman, Marion H., $CO_2$ Acceptor Process: Status of Development, pp. 229–235, Inf. Circ. 8650, U.S. Dept. of Interior, Bureau of Mines.

Center Line, Inc., "Air Cylinder Actuator".

*Primary Examiner*—Edward G. Favors

*Attorney, Agent, or Firm*—Dale Lovercheck; William A. Mikesell, Jr.

[57] ABSTRACT

A method and apparatus for controlling steam production by controlling the flow rate of particulate solids from a fluidized bed combustion chamber through a vertical heat exchanger. The pressure drop across a section of the vertical heat exchanger is monitored and compared with a set point pressure drop. When the pressure drop being monitored falls below the set point pressure drop, a signal is provided to a particulate solids feed control means which then allows more particulate solids to be circulated through the vertical heat exchanger. The vertical heat exchanger receives heat from the particulate solids. The additional amount of particulate solids fed to the vertical heat exchanger are recirculated along with the previous amount of particulate solids through the heat exchanger into the fluidized bed combustion chamber. Because of the additional cooled particulate solids in the fluidized bed combustion chamber the temperature of the fluidized bed combustion chamber drops. The temperature of the fluidized bed combustion chamber is monitored by temperature sensor when the temperature in the fluidized bed combustion chamber drops, a signal is provided to the fuel feed control means which provides additional fuel to the fluidized bed to provide additional heat to make up for the additional cooling in the vertical heat exchanger of the additional particulate solids.

5 Claims, 1 Drawing Figure

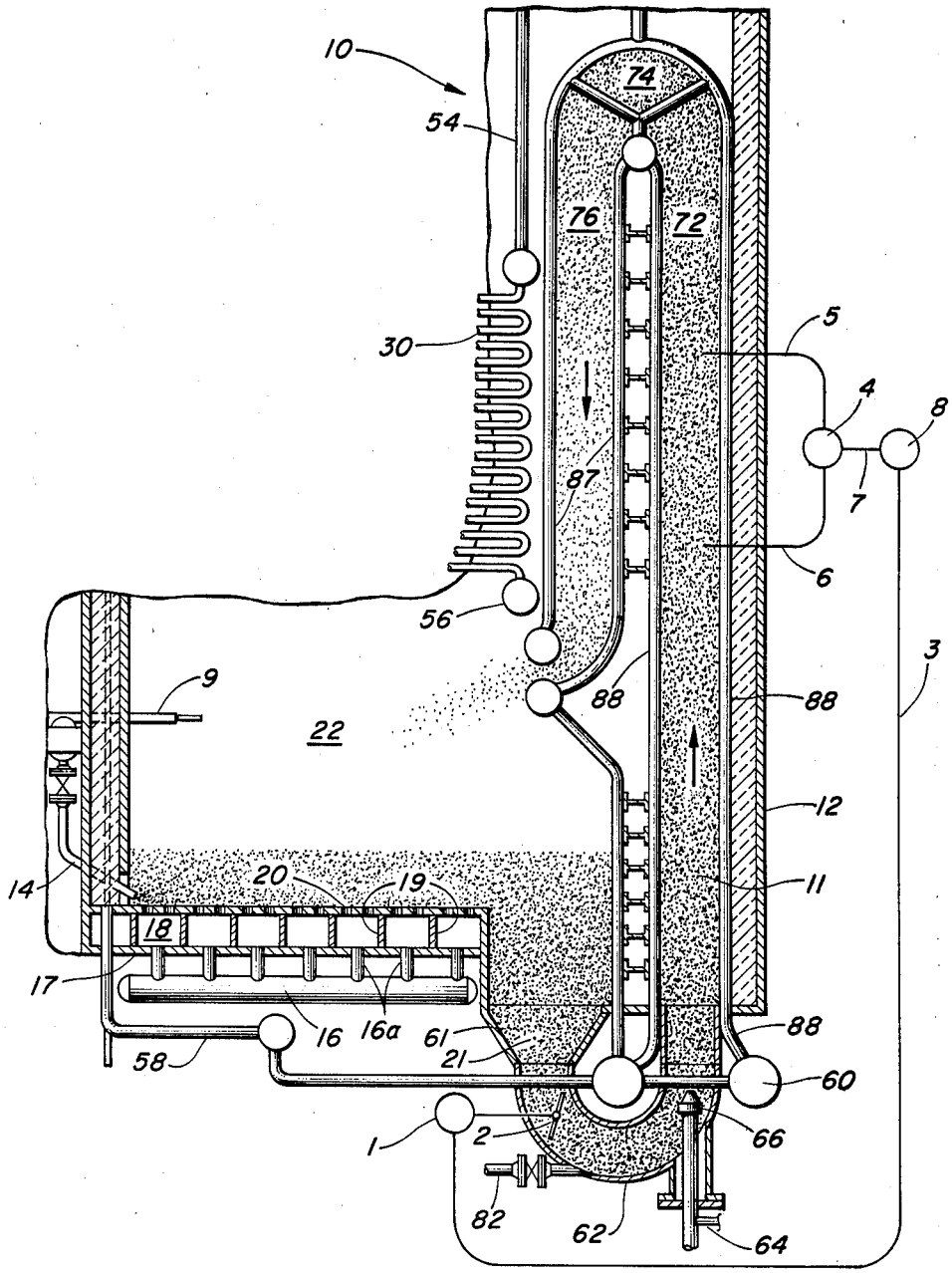
10
54
74
76
72
30
5
4
8
7
87
6
56
3
9
88
88
22
12
14
20
19
11
18
17
16
16a
61
88
58
21
60
1
2
66
82
62
64

TECHNIQUE AND APPARATUS FOR SOLIDS CIRCULATION CONTROL IN THE SOLIDS CIRCULATING BOILER

BACKGROUND OF THE INVENTION

Johnson in the U.S. Pat. No. 4,240,377 discloses a method and apparatus for carrying out fluidized bed combustion and transferring heat produced thereby to a boiler which includes providing a fluidized bed of particulate matter and introducing fuel particles thereinto, causing a portion of the fluidized bed constitutents to flow upwardly through a heat exchanger which is essentially free of any obstructions to the flow, and reintroducing the portion of fluidized bed constitutents which flow through the heat exchanger, back into the fluidized bed.

Center Line discloses a feed valve positioner and flow valve which may be adapted for use as applicant's particulate solids feed valve positioner and solids flow valve referred to later in the specification as 1 and 2 respectively.

Foxboro Company of Foxboro, Mass. 17-143 April 1963, p. 1 discloses controllers with set point transmitter which may be used in applicant's invention as differential pressure controller 8 as discussed later in the specification.

Foxboro Company of Foxboro, Mass. at 5-616, September 1955, p. 1 discloses d/p cell transmitters which may be used in applicant's invention as differential pressure transmitter 4.

SUMMARY OF THE INVENTION

A method and apparatus for controlling steam production by controlling the flow rate of particulate solids from a fluidized bed combustion chamber through a vertical heat exchanger. The pressure drop across a section of the vertical heat exchanger is monitored and compared with a set point pressure drop. When the pressure drop being monitored falls below the set point pressure drop, a signal is provided to a particulate solids feed control means which then allows more particulate solids to be circulated through the vertical heat exchanger. The vertical heat exchanger receives heat from the particulate solids. The additional amount of particulate solids fed to the vertical heat exchanger are recirculated along with the previous amount of particulate solids through the heat exchanger into the fluidized bed combustion chamber. Because of the additional cooled particulate solids in the fluidized bed combustion chamber the temperature of the fluidized bed combustion chamber drops. The temperature of the fluidized bed combustion chamber is monitored by temperature sensor when the temperature in the fluidized bed combustion chamber drops, a signal is provided to the fuel feed control means which provides additional fuel to the fluidized bed to provide additional heat to make up for the additional cooling in the vertical heat exchanger of the additional particulate solids.

BRIEF DISCUSSION OF THE DRAWING

The drawing show a partial cross sectional, partial schematic view of a fluidized bed combustion chamber with a vertical heat exchanger in accordance with the present invention.

DETAILED DISCUSSION OF THE INVENTION

Referring now more particularly to the embodiments of the invention illustrated in the accompanying drawing, a fluidized bed boiler indicated generally at 10 is shown having boiler or vessel walls 12 with a fuel inlet 14 which includes means for the introduction of a fuel. Fuel inlet device 14 may include any conventional feeder mechanism for injecting fuels such as a fossil fuel like fuel oil or a particulate fuel such as coal particles, or any combination thereof. Thus, for example, fuel inlet 14 may include a screw feeder for introducing particulate coal or, preferably, a spreader stroker which throws the particles for distribution over the entire fluidized bed.

The boiler 10 also includes air inlet 16 for the introduction of fluidizing gas having a combustible component (such as an oxygen containing gas, preferably air), under pressure, coupled to the combustion chamber for fluidizing the constituents making up the fluidized bed. To this end, boiler 10 includes a column chamber 18 formed by floor plate 17 partition members (preferably solid) 19 extending upwardly therefrom and a perforated distributor plate 20 supported by partition members 19 to form a plurality of air dispersion chambers (unnumbered) distributor plate 20 is hereshown extended across a major part of the lower cross section of the boiler, and may be tilted or sloped.

The fluidizing gas is introduced from inlet 16 into column chamber 18 (through inlet ducts **16*a* each leading to an air distribution chamber) for dispersion into the fluidized bed combustion chamber (indicated generally at 22) by dispersion plate 20 to fluidize the combustion bed constitutents. As here embodied, the fluidized bed may include an inert refractory material, such as sand, and preferably, a material which absorbs or reacts with undesired constitutents (particularly $SO_2$) in the fuel, such as dolomite or limestone particles, or any combination of such constitutents, with solid particulate or other combustible fuel, such as coal, tar sands, natural gas, etc. introduced therein to form a fluidized combustion bed of particulate matter in the fluidized bed combustion chamber 22. Advantageously the boiler 10 may be provided with a superheater 30 which receives water from a steam water separater boiler drum (not shown in the FIGURE) through the entrance to the superheater 54. The superheater 30 has exit header 56** therefrom, which is the exit for the superheated steam from the system and lead, for example, to a steam turbine.

Heat exchange fluid line 58 provides passage for heat exchange fluid from one of the mud drums 60 (adapted to separate solids from the fluid circulating through tubes 88), then through the tubes 88 forming the walls 87 of chambers 72, 74 and 76. The heat exchange fluid passes from the tubes 88 to the boiler drum (not shown).

The withdrawal duct 62 may have a generally circular cross sectional area while inlet member 61 may be tapered.

As preferably embodied, the nozzle 66 and the air inlet 64 are formed as integral adjustable nozzle valve which comprises a plug type valve or an injection type cone valve, such as described in U.S. Pat. No. 2,630,352. Accordingly, the valve includes a hollow central tube, enabling the introduction of the gas and additional fuel therethrough, as well as head portion controlling the size of the opening leading into upward chamber 72.

Alternatively, a slide valve may be used instead of nozzle valve 66.

As preferably embodied, the withdrawal duct 62 also includes a fluidizing or an aeration air inlet 82 which aids in fluidizing (i.e., controlling the density of) the solid particulate material from the fluidized bed 22 by providing an air flow entry into the withdrawal duct 62. It will be understood that the inlet 82 provides an additional control point for enabling control of the density of the fluidized particulate matter flowing into the flow chamber 72. The heat exchange tubes 88 which define the chambers 72, 74 and 76 constitute a vertical heat exchanger 11 across which heat from the particulate solids 21 is transferred into the heat exchange fluid contained within the heat exchanger 11. The chamber 72 is provided with upper pressure tap line 5 and lower pressure tap line 6 both of which are connected to the differential pressure transmitter 4. The differential transmitter 4 provides differential transmitter signal 7 to the differential pressure controller 8. The differential pressure controller 8 provides particulate solids feed control signal 3 to the particulate solids feed valve positioner 1. The particulate solids feed valve positioner 1 is connected to the solids flow valve 2.

The differential pressure controller 8 is provided with a set point which may be changed by the operator of the fluidized bed boiler to increase or decrease the amount of steam from the boiler. When the operator desires more steam from the boiler, he increases the set point of the differential pressure controller. The set point is a reference pressure drop preferably a range of pressure. When the pressure drop measured by the differential pressure transmitter is lower than the set point pressure drop set in the differential pressure controller by the operator the differential pressure controller sends a particulate solids feed control signal 3 to the particulate solids feed valve positioner which opens the solids flow valve 2 to allow additional particulate solids 21 into the chamber 72. These additional particulate solids provide additional heat through the vertical heat exchanger 11 to the heat exchange fluid contained within the vertical heat exchanger 11 which is transported to a boiler and provides additional heat to the boiler thus providing additional steam. The additional particulate solids 21 are recycled from chamber 72, 74 and 76 into the fluidized bed combustion chamber 22 where they have a cooling effect on the chamber. The fluidized bed combustion chamber 22 is provided with a thermocouple 9. When the temperature of the fluidized bed combustion chamber drops below its set operating temperature additional fuel is provided to the fluidized bed combustion chamber 22 by the fuel inlet 14. This may be done as is known in the art by signalling a pump when the temperature monitored by the thermocouple 9 falls below the desired fluidized bed combustion chamber operating temperature.

When less steam is desired from the fluidized bed boiler the operator may lower the set point in the differential pressure controller. Thus the differential pressure transmitter would be transmitting a signal 7 representative of a pressure drop in the chamber 72 larger than the differential pressure controller set point pressure drop. The differential pressure controller then sends a signal 3 to the particulate solids feed valve positioner 1 to move the solids flow valve 2 so that less particulate solids 21 enter the chamber 72. The particulate solids 21 contain the heat for transfer into the heat transfer fluid in the vertical heat exchanger 11. Having less particulate solids to transfer heat to the heat transfer fluid less heat is transferred and less steam is produced from the fluidized bed boiler upon being recycled through chamber 72 into the fluidized bed combustion chamber 22 the particulate solids 21 returning to the fluidized bed combustion chamber require less fuel to heat them to the operating temperature of the bed. Thus, the temperature of the bed will raise to the bed operating temperature at which time the thermocouple 9 will signal the fuel controller (not shown) and less fuel will be provided through fuel inlet 14 to the fluidized bed combustion chamber.

In the overall operation of the fluidized bed boiler in accordance with the present invention the pressure drop in the vertical chamber is used as the control input to control the amount of steam produced in the fluidized bed boiler. This advantageously provides an improved control over the amount of steam produced in the fluidized bed with attendant uniformity and precision in controlling the amount of steam produced from the fluidized bed boiler.

Accordingly, it will be understood that variations may be made from the specific embodiments disclosed herein, which are within the scope of the accompanying claims without departing from the principles of the invention and without sacrificing its chief advantages.

What is claimed is:

1. In a fluidized bed heat exchanger wherein particulate solids are circulated from a fluidized-bed combustion zone by way of a flow-control zone upwardly through an elongated vertically disposed heat exchange zone and thence back to said combustion zone, the method of controlling the rate of circulation of said particulate solids which comprises:

measuring the pressure differential between two points along said heat exchange zone, comparing the measured value of said differential to a predetermined reference value, generating a control signal responsive to said comparing, and utilizing said control signal to permit increased flow of said particulate solids through said flow control zone responsive to a decrease in said pressure differential and a decreased flow of said solids responsive to an increase in said differential.

2. The method of claim 1 further characterized by measuring the temperature at a location within said combustion chamber, comparing said temperature to a predetermined temperature value to produce a control signal representative of temperature difference, and utilizing said latter control signal to adjust the rate of addition of fuel to said combustion zone.

3. An apparatus for controlling the flow rate of particulate solids to a heat exchanger from a fluidized bed combustion chamber comprising, a fluidized bed combustion chamber, a heat exchange means, a differential pressure sensing means connected to said heat exchange means, means for passing particulate solids from said chamber to said heat exchange means, and control means responsive to said sensing means adapted to regulate said means for passing particulate solids.

4. The apparatus of claim 3 wherein said differential pressure sensing means comprises a differential pressure transmitter means.

5. The apparatus of claim 4 wherein said differential pressure sensing means further comprises an upper pressure sensor and a lower pressure sensor, said upper pressure sensor and said lower pressure sensor each providing a signal to said differential pressure transmitter means.

* * * * *